US005507327A

United States Patent [19]

Ziegler

[11] Patent Number: 5,507,327

[45] Date of Patent: Apr. 16, 1996

[54] FUNNEL AND AUTOMATIC SUPPLY SYSTEM FOR LIQUID NITROGEN

[75] Inventor: Alex R. Ziegler, Los Gatos, Calif.

[73] Assignee: VBS Industries, Inc., Campbell, Calif.

[21] Appl. No.: 411,521

[22] Filed: Mar. 28, 1995

[51] Int. Cl.[6] ..... B65B 1/30; B65B 3/28

[52] U.S. Cl. ..... 141/199; 141/331; 141/339; 141/82

[58] Field of Search ..... 141/199, 203, 141/204, 331, 339, 286, 297, 95, 198, 82, 332–338, 340–345; 222/67, 185.1, 460, 51

[56] References Cited

U.S. PATENT DOCUMENTS

| | | | |
|---|---|---|---|
| 1,402,835 | 1/1922 | Bywater et al. | 222/67 |
| 3,207,372 | 9/1965 | Evans | 222/67 |
| 4,407,340 | 10/1983 | Jenson et al. | 141/67 |
| 4,905,743 | 3/1990 | Gray | 141/95 |

FOREIGN PATENT DOCUMENTS

| | | | |
|---|---|---|---|
| 4-87903 | 3/1992 | Japan | 141/339 |
| 1455652 | 1/1973 | United Kingdom . | |
| 1599533 | 4/1977 | United Kingdom . | |

*Primary Examiner*—Henry J. Recla
*Assistant Examiner*—Steven O. Douglas
*Attorney, Agent, or Firm*—Law Offices Of Thomas E. Schatzel

[57] ABSTRACT

A hollow-walled cylindrical stainless steel vacuum-insulated funnel with a flat bottom through which a float valve and screen check and filter the gravity flow of liquid nitrogen out through a drain pipe in the bottom. The bottom of the funnel has a small lip raised all around the small pipe outlet to prevent any water condensation inside the funnel from dripping into the EDX dewar. The pipe outlet pierces a dewar stopper and can be permanently left in place on top of a dewar. The hollow-walls of the funnel are packed with foil-backed film in laminations to reduce radiation heat transfer between the funnel's inside and outside walls. A vacuum is drawn inside the hollow walls to minimize heat conduction.

16 Claims, 2 Drawing Sheets

FUNNEL AND AUTOMATIC SUPPLY SYSTEM FOR LIQUID NITROGEN

BACKGROUND OF THE INVENTION

1. Field of the Invention

The invention relates generally to liquid nitrogen handling equipment and more specifically to funnels with vacuum-insulated walls and float valves for filling small atmospheric pressure dewars of liquid nitrogen used, for example, by high-performance auxiliary equipment on scanning electron microscopes that are generally referred to as energy dispersive x-ray (EDX) accessories.

2. Description of the Prior Art

When liquid nitrogen is held in a container with any kind of pressure, pouring or piping it out into an atmospheric pressure vessel becomes a great problem because the liquid almost unavoidably changes phase to a gas and liquid mixture that is difficult to deal with. The handling of liquid nitrogen is a common chore in laboratories equipped with scanning electron microscopes (SEMs). Reservoirs of liquid nitrogen, commonly called dewars", are held high above the laboratory floor on top of the EDXs to help chill the sensitive electronic detectors. Such dewars have insulated walls and corks of foam that are used as stoppers. Because it is critical that such reservoirs never go empty, a technician must routinely climb a step ladder, pull out the stopper and pour in the liquid nitrogen until the dewar is full. The stopper must be replaced immediately, or chilled air will form water crystals of ice around and inside the top of the dewar and contaminate the liquid nitrogen supply inside the dewar.

SEMs are extremely sensitive to vibrations since they multiply images by as much as one hundred thousand times and are often used to scan features smaller than one micron. Therefore, SEMs are conventionally isolated from general building vibrations by locating them completely on a special vibration-free table. Piping and plumbing systems for pumping liquid nitrogen directly to an SEM from an outside tank suffer from the same outside building vibrations. Any physical connection of such plumbing systems to the SEM EDX dewar can transfer unwanted vibrations to the SEM. Therefore, conventional liquid nitrogen supply systems do not plumb the liquid nitrogen from an outside source to the SEM. Hand-held flasks have been universally used to manually fill SEM EDX dewars with standard funnels. Because of their conventional construction, ordinary funnels must be removed immediately after use.

SUMMARY OF THE PRESENT INVENTION

It is therefore an object of the present invention to provide a permanently-installed funnel for filling a dewar with liquid nitrogen.

It is a further object of the present invention to provide a funnel that simplifies the filling of dewars with liquid nitrogen such that such filling can be automated without introducing constant vibration that would disturb the normal operation of a scanning electron microscope for other than brief periods during filling.

Briefly, an embodiment of the present invention comprises a hollow-walled cylindrical stainless steel funnel with a flat bottom through which a float valve and screen check and filter the gravity flow of liquid nitrogen out through a small pipe in the bottom. The bottom of the funnel has a small lip raised all around the small pipe outlet to prevent any water condensation inside the funnel from dripping into the EDX dewar. The pipe outlet pierces a dewar stopper and can be permanently left in place on top of a dewar. The hollow-walls of the funnel are packed with foil-backed film in laminations to reduce radiation heat transfer between the funnel's inside and outside walls. A vacuum is drawn inside the hollow walls to minimize heat conduction through the walls.

An advantage of the present invention is that a funnel is provided that drains readily into a liquid nitrogen dewar.

Another advantage of the present invention is that a funnel is provided that can be left in place permanently and requires no handling of a stopper to prevent water vapor contamination with ice crystals into the dewar.

A further advantage of the present invention is that a funnel is provided that mechanically isolates a dewar from the vibrations inherent in a liquid nitrogen supply system.

These and other objects and advantages of the present invention will no doubt become obvious to those of ordinary skill in the art after having read the following detailed description of the preferred embodiment which is illustrated in the drawing figures.

IN THE DRAWINGS

DETAILED DESCRIPTION OF THE PREFERRED EMBODIMENTS

Figure 1B:
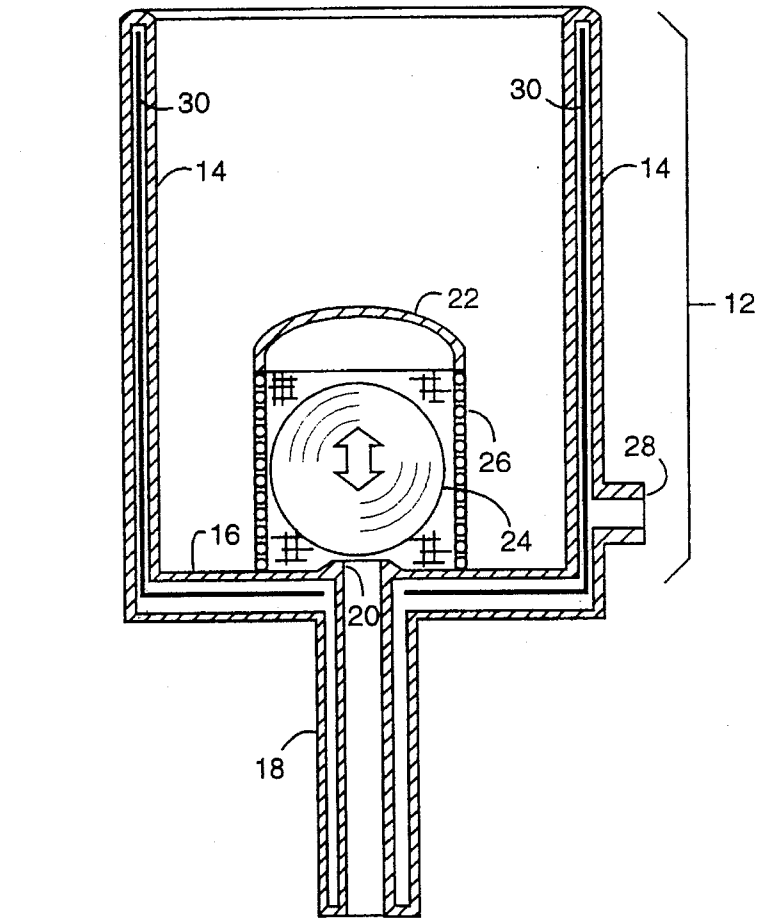
FIG. 1B is a cross-sectional diagram of the vacuum-insulated liquid nitrogen funnel of FIG. 1A taken along the line 1B—1B.
Figure 1A:
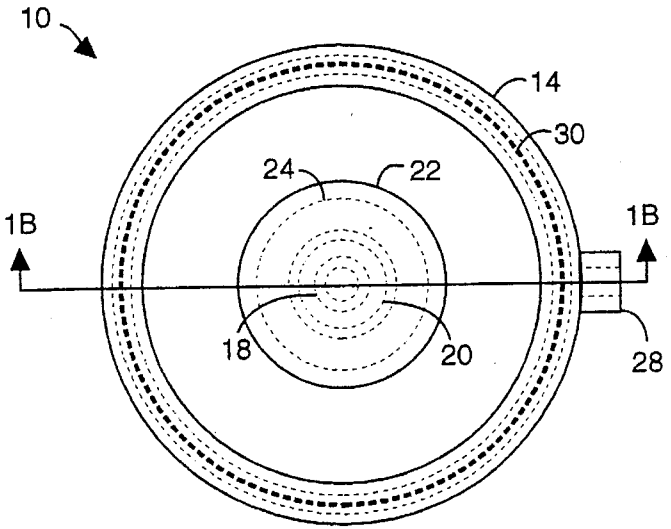
FIG. 1A is a top view of a vacuum-insulated liquid nitrogen funnel of the present invention.

FIGS. 1A and 1B illustrate a vacuum-insulated liquid nitrogen funnel embodiment of the present invention, referred to by the general reference numeral 10. The funnel 10 comprises a cylindrical section 12 with a hollow-wall 14 set at right angles to a flat bottom 16. The ordinary conical section configuration of conventional funnels does not function well to drain liquid nitrogen because a gas-liquid phase vortex is set up by the warming of the liquid nitrogen and its change to the gas phase at the wall edges. The swirl of the vortex inhibits gravity draining of the liquid nitrogen.

The funnel 10 includes a drain tube 18 and a lip 20 that is raised slightly above the floor 16 to trap any moisture that condenses on the walls 14 and flows to the bottom 16. A splash cap 22 provides a protective roof to prevent interference from a direct stream of liquid nitrogen poured into the funnel 10 from above with a float-check ball 24 and serves to prevent any water droplets from falling straight through the drain tube 18. A wire mesh 26 cages the float-check ball 24 and filters out any solid contamination from the liquid nitrogen passing down through the drain tube 18. Such contamination comprises, for example, ice crystals formed by the exposure of water vapor in the air to the cryogenic temperatures of the liquid nitrogen. The float-check ball 24 preferably has such a low specific gravity, compared to liquid nitrogen, that it rides almost entirely on the surface of liquid nitrogen. For example, the float-check ball 24 may be a hollow plastic ball filled with air, as in a ping-pong ball. The float-check ball 24 seats against the raised lip 20 to form a seal when substantially all the liquid nitrogen has drained out. Such a seal acts to exclude air and water vapor from traveling down the drain tube 18 behind the liquid nitrogen flow.

A vacuum is maintained within the hollow-wall 14 with a vacuum evacuation valve and seal-off connection 28 to reduce heat intrusion by heat conduction from the outside to the liquid nitrogen inside the funnel 10. Heat intrusion by radiation is preferably controlled by filling the hollow-wall 14 with a metal-on-plastic-film laminate 30. For example, aluminum foil on MYLAR film may be used.

Figure 2:
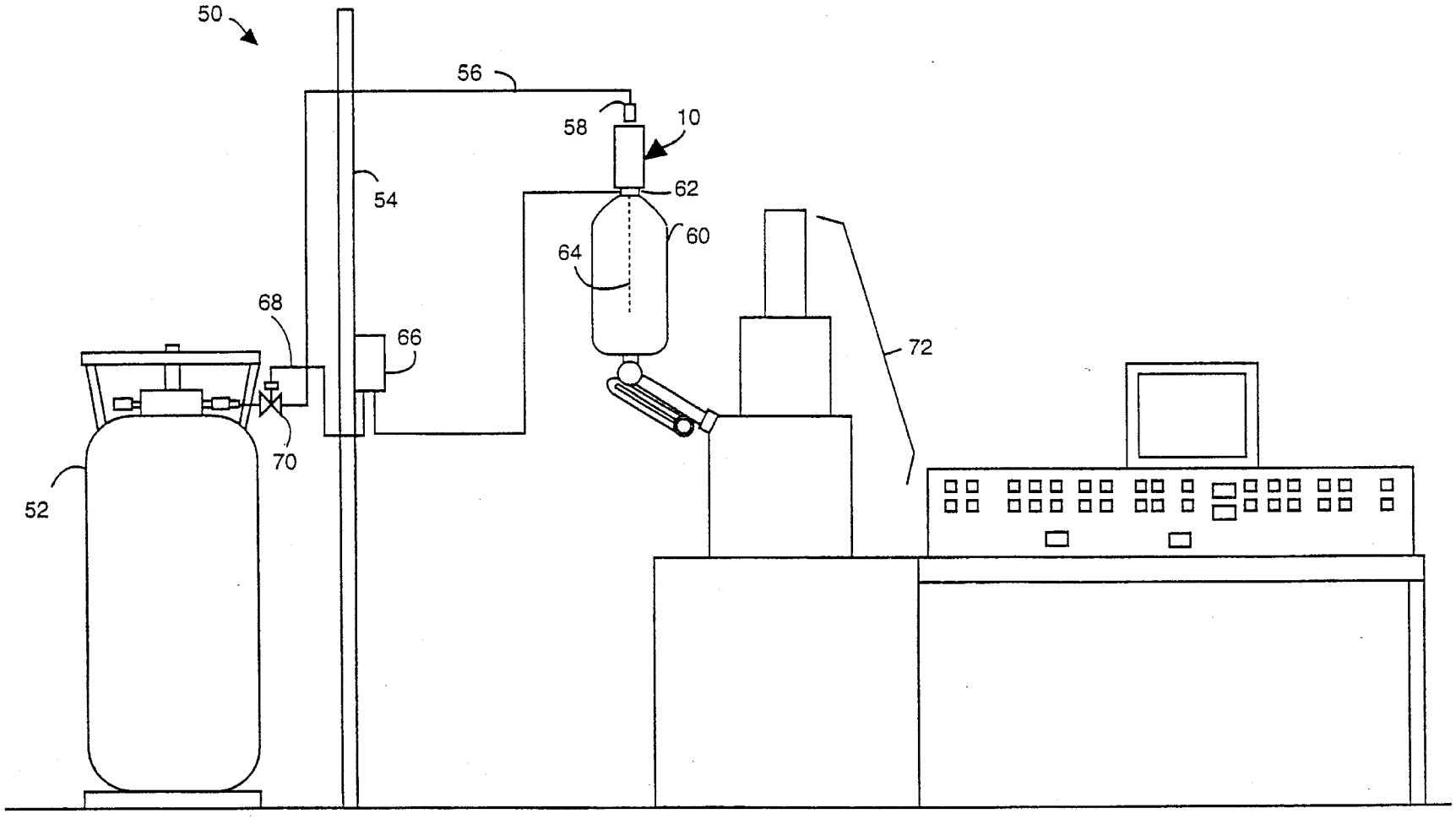
FIG. 2 is a front view of an automatic liquid nitrogen supply system of the present invention and a scanning electron microscope with a dewar to be kept filled with the liquid nitrogen.

In FIG. 2, an automatic liquid nitrogen supply system 50 is shown to comprise an outdoor tank 52 of liquid nitrogen connected through an outside building wall 54 by a vacuum-insulated transfer hose 56 to a sintered-metal phase separator 58. Liquid nitrogen pours from the sintered-metal phase separator 58 into the funnel 10 (as in FIG. 1), which is mounted to a dewar 60 with the funnel's drain pipe piercing a dewar stopper 62. A probe 64 senses the level of liquid nitrogen in the dewar 60 and connects an electronic signal to a liquid nitrogen level controller 66. A solenoid control cable 68 operates a solenoid 70 to adjust the delivery of liquid nitrogen through the transfer hose 56 according to the level of liquid nitrogen sensed by the probe 64 in the dewar 60. The sintered-metal phase separator 58 and the funnel 10 are not mechanically connected to each other to prevent vibrations in the transfer hose 56 and building from disturbing the operation of a scanning electron microscope (SEM) 72. Liquid nitrogen is gravity fed from the dewar 60, as is conventional.

Although the present invention has been described in terms of the presently preferred embodiment, it is to be understood that the disclosure is not to be interpreted as limiting various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A funnel, comprising:

a cylindrical section with a flat bottom and an open top to receive liquid gases at cryogenic temperatures, the cylindrical section being comprised of hollow walls defining a cavity adapted to be maintained at an evacuated atmosphere and provide for restricted heat conduction from outside to inside said hollow walls;

a drain tube connected as an outlet from said flat bottom; and a float check valve positioned within the cylindrical section and providing for an opening of the drain tube in the presence of liquid nitrogen and for a closing off of said drain tube when said cylindrical section is empty of said liquid.

2. The funnel of claim 1, wherein:

said hollow walls contain a laminate of metal on plastic film and provide for restricted heat radiation from outside to inside said hollow walls.

3. The funnel of claim 1, wherein:

said hollow walls contain a vacuum which provides for restricted heat conduction and a laminate of metal on plastic film which provides for restricted heat radiation from outside to inside said hollow walls.

4. The funnel of claim 1, further comprising:

a raised lip encircling the drain tube on said flat bottom and providing for the retaining of any condensation of water vapor in said cylindrical section.

5. The funnel of claim 1, further comprising:

a filter screen positioned to strain and filter said liquid gases flowing from the cylindrical section out through the drain tube, wherein ice crystal are prevented from contaminating the outflow of said liquid gases.

6. A funnel, comprising:

a cylindrical section with a flat bottom, an open top to receive liquid gases at cryogenic temperatures, and hollow walls defining a cavity adapted to be maintained at an evacuated atmosphere that provide for restricted heat conduction and a laminate of metal on plastic film that provides for restricted heat radiation from outside to inside said hollow walls;

a drain tube connected as an outlet from said flat bottom;

a raised lip encircling the drain tube on said flat floor and providing for the retaining of any condensation of water vapor in said cylindrical section;

a float check valve positioned within the cylindrical section and providing for an automatic opening of said drain tube when immersed in a liquid and for a self-closing of said drain tube when said cylindrical section is empty of said liquid; and a filter screen positioned to strain and filter said liquid gases flowing from the cylindrical section out through the drain tube, wherein ice crystals are prevented from contaminating the outflow of said liquid.

7. An automatic liquid gas supply system for a dewar, comprising:

a funnel for insertion into the top of a dewar and including a cylindrical section with a flat bottom and an open top to receive liquid gases at cryogenic temperatures, a drain tube connected as an outlet from said flat bottom, and a float check valve positioned within the cylindrical section and providing for an opening and a closing off of said drain tube when said cylindrical section is empty of said liquid gases;

a sintered-metal phase separator positioned to drop said liquid gases into the funnel in a flow from above and having no mechanical connection to the funnel through which mechanical vibrations could be conducted;

a vacuum-insulated transfer hose connected to supply said liquid gases to the sintered-metal phase separator;

a solenoid valve connected to supply said liquid gases to the vacuum-insulated transfer hose from a tank;

a liquid gas level controller including a liquid level probe inserted into said dewar and connected to control the solenoid valve, wherein a supply of said liquid gases is maintained within said dewar.

8. The system of claim 7, wherein:

said cylindrical section of the funnel is comprised of hollow walls defining said cavity maintained at an evacuated atmosphere and provide for restricted heat conduction from outside to inside said hollow walls.

9. The system of claim 7, wherein the funnel, wherein:

said cylindrical section of the funnel is comprised of hollow walls that contain a laminate of metal on plastic film and provide for restricted heat radiation from outside to inside said hollow walls.

10. The system of claim 7, wherein the funnel, wherein:

said cylindrical section of the funnel is comprised of hollow walls defining a cavity maintained at an evacuated atmosphere which provides for restricted heat conduction and a laminate of metal on plastic film which provides for restricted heat radiation from outside to inside said hollow walls.

11. The system of claim 7, wherein the funnel further comprises:

a raised lip encircling the drain tube on said flat floor and providing for the retaining of any condensation of water vapor in said cylindrical section.

12. The system of claim 7, wherein the funnel further comprises:

a filter screen positioned to strain and filter said liquid gases flowing from said cylindrical section of the funnel out through the drain tube, wherein ice crystals are prevented from contaminating the outflow of said liquid gases.

13. An automatic liquid gas supply system for a dewar, comprising:

a funnel including cylindrical section with a flat bottom, an open top to receive liquid gases at cryogenic temperatures, and hollow walls of stainless steel adapted to be maintained at an evacuated atmosphere that provide for restricted heat conduction and a laminate of metal on plastic film that provides for restricted heat radiation from outside to inside said hollow walls, a drain tube connected as an outlet from said flat floor and providing for the retaining of any condensation of water vapor in said cylindrical section, a float check valve with a hollow plastic ball positioned within the cylindrical section and providing for an automatic opening of said drain tube when the cylindrical section is filled with said liquid gases and a self-closing of said drain tube when said cylindrical section is substantially empty of said liquid gases, and further including a filter screen positioned to strain and filter said liquid gases flowing from the cylindrical section out through the drain tube, wherein ice crystals are prevented from contaminating the outflow of said liquid gases;

a sintered-metal phase separator positioned to drop said liquid gases into the funnel in a flow from above and having no mechanical connection to the funnel through which mechanical vibrations could be conducted;

a vacuum-insulated transfer hose connected to supply said liquid gases to the sintered-metal phase separator;

a solenoid valve connected to supply said liquid gases to the vacuum-insulated transfer hose from a tank; and a liquid level controller including a liquid level probe or insertion into said dewar and connected to control the solenoid valve, wherein a supply of said liquid gases is maintained within said dewar.

14. The system of claim 13, further comprising:

a dewar attached to a scanning electron microscope and connected to receive said liquid gases from said drain tube of the funnel.

15. A funnel, comprising:

a cylindrical section with a flat bottom and an open top to receive liquid gases at cryogenic temperatures and hollow walls that contain a laminate of metal on plastic film to provide for restricted heat radiation from outside to inside said hollow walls;

a drain tube connected as an outlet from said flat bottom; and a float check valve positioned within the cylindrical section and providing for an opening of the drain tube in the presence of liquid nitrogen and for a closing off of said drain tube when said cylindrical section is empty of said liquid.

16. A funnel, comprising:

a cylindrical section with a flat bottom and an open top to receive liquid gases at cryogenic temperature and hollow walls adapted to be maintained at an evacuated atmosphere which provides for restricted heat conduction and a laminate of metal on plastic film which provides for restricted heat radiation from outside to inside said hollow walls;

a drain tube connected as an outlet from said flat bottom; and a float check valve positioned within the cylindrical section and providing for an opening of the drain tube in the presence of liquid nitrogen and for a closing off of said drain tube when said cylindrical section is empty of said liquid.

* * * * *